US009949332B2

(12) United States Patent
Wang

(10) Patent No.: US 9,949,332 B2
(45) Date of Patent: Apr. 17, 2018

(54) LED CIRCUIT AND DRIVING METHOD THEREOF

(71) Applicant: MAINTECH SEMICONDUCTOR INC., New Taipei (TW)

(72) Inventor: Chi-Gin Wang, New Taipei (TW)

(73) Assignee: MAINTECH SEMICONDUCTOR INC., New Taipei (TW)

( * ) Notice: Subject to any disclaimer, the term of this patent is extended or adjusted under 35 U.S.C. 154(b) by 692 days.

(21) Appl. No.: 14/521,436

(22) Filed: Oct. 22, 2014

(65) Prior Publication Data

US 2015/0341994 A1 Nov. 26, 2015

(30) Foreign Application Priority Data

May 20, 2014 (TW) ..... 103117545 A
Jun. 24, 2014 (TW) ..... 103121782 A

(51) Int. Cl.
*H05B 33/08* (2006.01)
*H05B 37/02* (2006.01)

(52) U.S. Cl.
CPC ..... *H05B 33/086* (2013.01); *H05B 33/0806* (2013.01); *H05B 33/0815* (2013.01); *H05B 33/0824* (2013.01); *H05B 33/0845* (2013.01); *H05B 37/0263* (2013.01)

(58) Field of Classification Search
CPC ..... H05B 33/086; H05B 37/02
See application file for complete search history.

(56) References Cited

U.S. PATENT DOCUMENTS

2014/0035481 A1* 2/2014 Peting ..... H05B 37/0245 315/291
2014/0354156 A1* 12/2014 Yang ..... H05B 33/0815 315/122

FOREIGN PATENT DOCUMENTS

| | | | |
|---|---|---|---|
| CN | 201225541 | Y | 4/2009 |
| CN | 101603648 | A | 12/2009 |
| CN | 101521974 | B | 9/2012 |
| CN | 102696282 | A | 9/2012 |
| CN | 101292574 | B | 12/2012 |
| CN | 102811521 | A | 12/2012 |
| TW | M338524 | U | 8/2008 |
| TW | 201247014 | A1 | 11/2012 |

OTHER PUBLICATIONS

Office actions from TW Patent Office dated Mar. 23, 2015.

* cited by examiner

*Primary Examiner* — Douglas W Owens
*Assistant Examiner* — Laura Yesildag
(74) *Attorney, Agent, or Firm* — The PL Law Group, PLLC

(57) ABSTRACT

An LED circuit includes a series of LED devices, a power supply circuit and a signal control circuit. Each of the LED devices includes an LED unit and an integrated circuit unit having a specific serial number and receiving an electrical parameter. The signal control circuit is coupled to the power supply circuit and the series of LED devices, and has a loaded status. The signal control circuit changes the loaded status in response to a control signal so as to cause the electrical parameter to have a variation, the variation of the electrical parameter generates a signal code having an information, all the integrated circuit units receive the signal code, and a specific LED unit will be driven by a corresponding integrated circuit unit when the signal code corresponds to the specific serial number of the corresponding integrated circuit unit.

6 Claims, 9 Drawing Sheets

LED CIRCUIT AND DRIVING METHOD THEREOF

CROSS-REFERENCE TO RELATED APPLICATION AND CLAIM OF PRIORITY

The application claims the benefit of Taiwan Patent Applications No. 103117545 and 103121782, filed on May 20, 2014 and Jun. 24, 2014 respectively, in the Taiwan Intellectual Property Office, the disclosures of which are incorporated herein in their entirety by reference.

FIELD OF THE INVENTION

The present invention relates to an LED circuit capable of producing different luminescence and colors, and a driving method for the circuit.

BACKGROUND OF THE INVENTION

In recent years, more and more attention has been paid to the concepts of environmental conservation. As the light-emitting diode (Light Emitting Diode, LED) lighting technology continues to progress, LED's luminous efficiency has gone beyond the conventional lighting device, and therefore LED lighting is widely used in various applications such as LED headlamp, LED searchlight, LED projecting lamp, LED decorative lighting, etc.

For conventional LED lamps, to control the variation of the luminescence and color of an LED at specific position, it usually needs additional signal transmission lines and a control circuit, which are costly and complicated. In addition, since the conventional LED lights are disposed in series, if anyone of the LED lights or the integrated circuit does not work, unless the failure can be found and fixed, the entire LED lighting device can not be functioning.

Please refer to FIG. 1, which is a schematic diagram showing an LED lighting series module 10 according to the prior art. The traditional LED lighting series module 10 includes a power converter 101 and a plurality of LED units 102 connected in series. The power converter 101 includes a micro controller 1010, and converts a commercial power AC1 into a first voltage $V_{DC1}$ between terminals V+ and V− so as to support the plurality of LED units 102. The power converter 102 also converts the commercial power AC1 into a second voltage $V_{DC2}$ so as to support the micro controller 1010, which is electrically connected to a first LED unit 1021 via a first signal line 103. The first LED unit 1021 is electrically connected to a second LED unit 1022 via a second signal line 104. Likewise, a required number of LED units to be connected in series can be achieved. The micro controller 1010 provides a control signal SC1 to control the first LED unit 1021, while the first LED unit transmits a control signal SC2 to the second LED unit 1022 in response to the first control signal SC1. Likewise, control signals can be transmitted to each of the LED unit in series.

The aforementioned method for driving the LED units may respectively control the lighting status, such as illuminating, dim or flickering, of each of the LED units SC1, SC2, . . . , SCn by conveying the control signals to each of LED units, respectively. However, the method needs additional data lines provided for the control, and there exist delays of the control signals SC2, . . . , SCn, which therefore derives the delay issues in addition to the complexity thereof.

In the application documents of Taiwan Model Patent No. M343822, which provides a two-wired AC LED light serial circuit, LED control signals are transmitted via AC power to control the dim/light of specific LED light of the same color. However, the control signal must be transmitted within a particular period of time which is the zero crossing of AC voltage. That is, both the power supply signal and the control signal coexist with the use of time division. Transmitting control signals in this manner result in low efficiency, because the transfer control signal is subject to the frequency of the commercial power, e.g., usually 60 Hz, and the transmission time period of the AC voltage is also restricted by the specific time period of zero-crossing zone.

In summary, the prior art includes the following drawbacks:

1. The whole series of LED units cannot be used if one of the LED units in the LED series is burnt out.
2. There exist delays of the control signals, and the control signals cannot be received at the same time.
3. The transmission time period of the AC voltage is restricted by the specific time period of zero-crossing zone.
4. The control signal according to the prior art can only control the dim/light of the LED of the same color.

In order to overcome the drawbacks in the prior art, an LED circuit and a driving method for the LED circuit, and more particularly an LED circuit capable of generating different luminescence as well as color variations and a driving method for the LED circuit is provided. The novel design in the present invention not only solves the problems described above, but also is easy to be implemented. Thus, the present invention has utility for the industry.

SUMMARY OF THE INVENTION

In accordance with one aspect of the present invention, an LED circuit is provided. The LED circuit comprises a series of LED devices, a power supply circuit and a signal control circuit. Each of the LED devices includes an LED unit and an integrated circuit unit having a specific serial number and receiving an electrical parameter. The power supply circuit is coupled to the series of LED devices. The signal control circuit is coupled to the power supply circuit and the series of LED devices, and has a loaded status. The signal control circuit changes the loaded status in response to a control signal so as to cause the electrical parameter to have a variation, the variation of the electrical parameter generates a signal code carrying an information, all the integrated circuit units receive the signal code, and a specific LED unit will be driven by a corresponding integrated circuit unit when the signal code corresponds to the specific serial number of the corresponding integrated circuit unit.

In accordance with a further aspect of the present invention, a method for driving an LED circuit is provided. The LED circuit comprises a plurality of integrated circuit units, a plurality of LED units and a signal-encoding circuit, wherein each of the integrated circuit units has a specific serial number. The method comprising steps of: (a) providing a control signal; (b) changing a loaded status of the signal encoding circuit in response to the control signal so as to generate a signal code; (c) causing all the integrated circuit units to receive the signal code having an information; and (d) driving a specific LED unit based on the information of the signal code by a corresponding integrated circuit unit when the signal code corresponds to the specific serial number of the corresponding one in the plurality of integrated circuit units.

In accordance with a further aspect of the present invention, a method for driving an LED circuit is provided. The LED circuit comprises a signal encoding circuit and a plurality of LED devices, wherein each of the LED devices includes an LED unit and an integrated circuit unit having a specific serial number. The method includes steps of: (a) electrically connecting at least one load to the plurality of LED devices in parallel; and (b) compensating each of the integrated circuits for a shift of an electrical characteristic thereof.

In accordance with a further aspect of the present invention, an LED circuit is provided. The LED circuit comprises a plurality of LED devices, each of which includes an LED unit and an integrated circuit unit having a specific serial number, a processing unit and a signal control circuit. The processing unit has an output terminal. The signal control circuit is coupled to the output terminal and the plurality of LED devices, and transmits an electrical parameter carrying a specific signal code to each of the integrated circuit units. A specific integrated circuit unit drives a corresponding LED unit when the specific integrated circuit unit identifies the specific signal code.

In accordance with a further aspect of the present invention, an LED circuit is provided. The LED circuit comprises a constant current source, a route-switching circuit and an LED open-circuit detecting circuit. The constant current source drives an LED unit in a first LED device. The route-switching circuit selectively connects the LED unit and a second LED device. The LED open-circuit detecting circuit causes the route-switching circuit to conduct the constant current source and the LED unit when the LED unit is in a closed status, and causes the route-switching circuit to conduct the constant current source and the second LED device when the LED unit is in an open status.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for the purposes of illustration and description only; it is not intended to be exhaustive or to be limited to the precise form disclosed.

Figure 1:
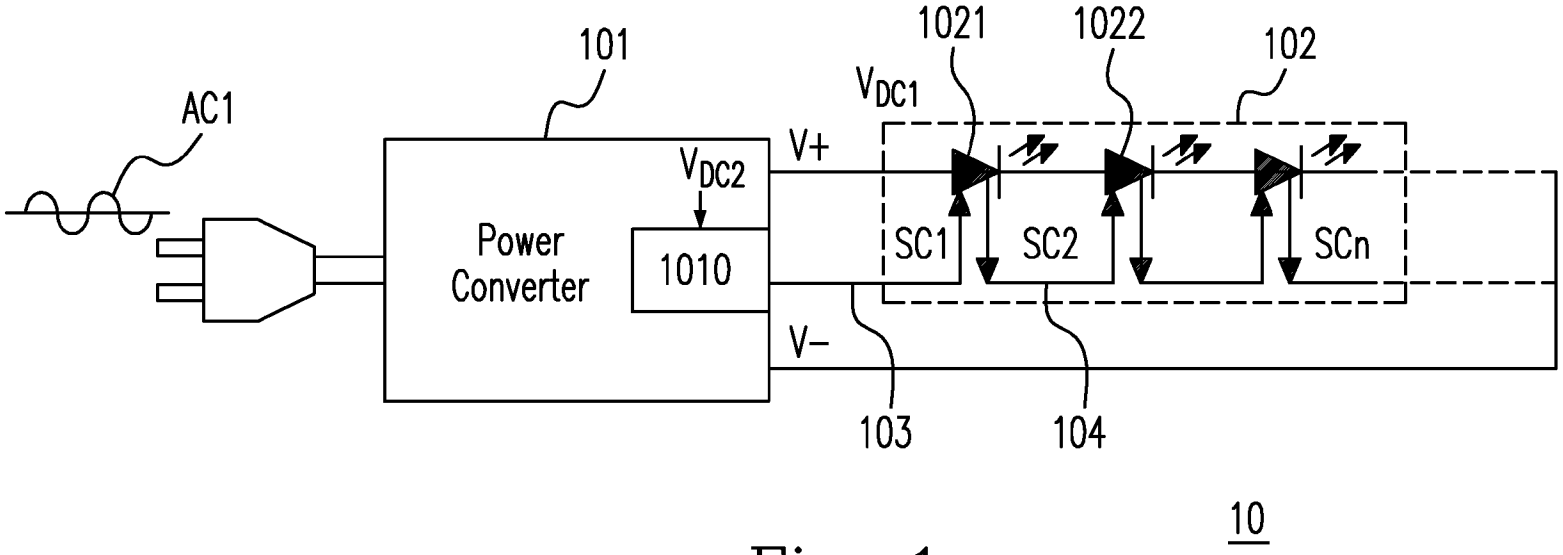
Fig. 1 (Prior Art)
FIG. 1 is a schematic diagram showing an LED lighting series module 10 according to the prior art.
Figure 2:
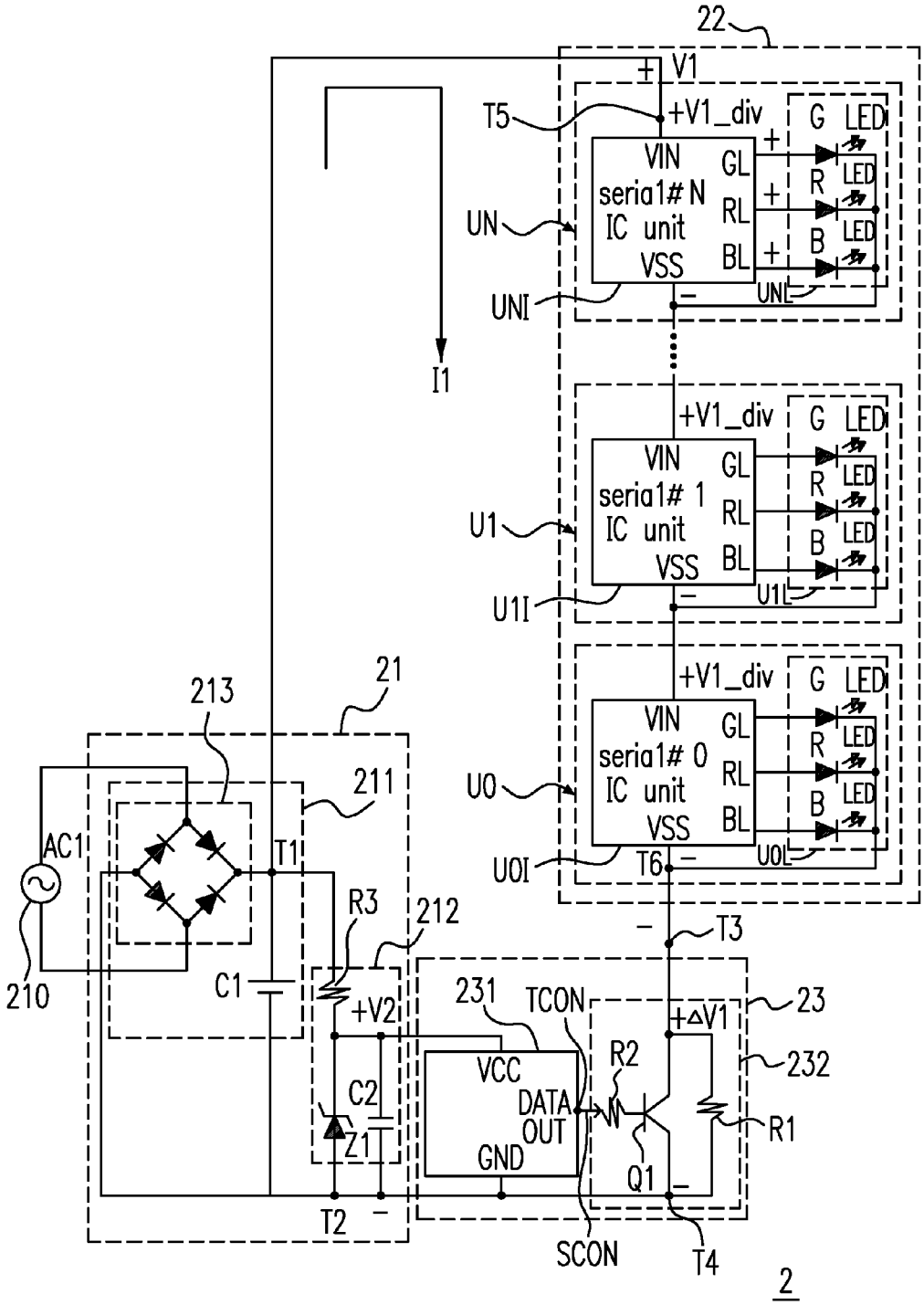
FIG. 2 is a schematic diagram showing an LED circuit according to a preferred embodiment of the present invention.
Figure 3:
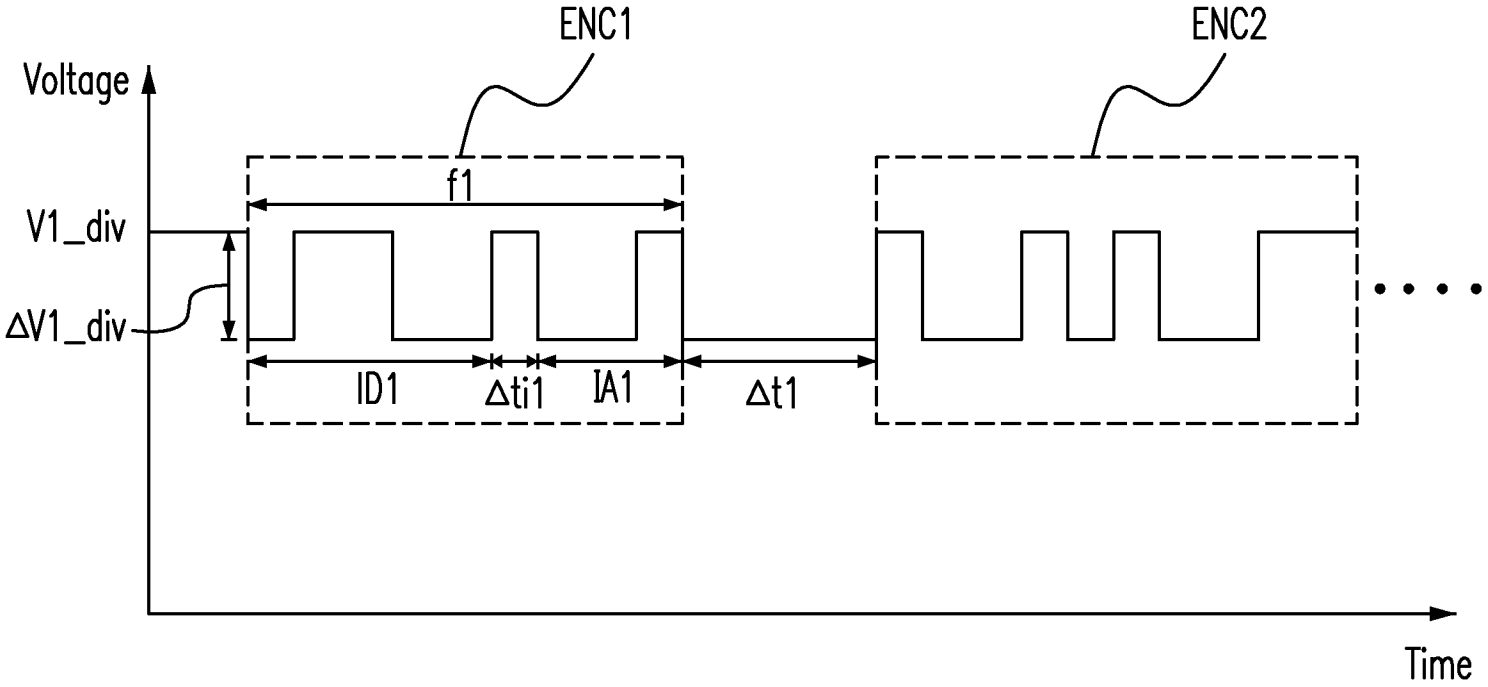
FIG. 3 is a schematic diagram showing the variation of voltage in each of the integrated circuit (IC) unit U0I, U1I, . . . , UNI in the LED circuit according to one embodiment of the present invention.

Referring to FIGS. 2 and 3, which are respectively a schematic diagram of the LED circuit 2 according to a preferred embodiment of the present invention and a schematic diagram showing the variation of voltage in each of the integrated circuit (IC) units U0I, U1I . . . and UNI in the LED circuit 2. The LED circuit 2 includes a power supply circuit 21, a series of LED devices 22 and a signal control circuit 23. The series of LED devices 22 includes a plurality of LED units U0L, U1L . . . and UNL, each of which has an IC circuit unit U0I, U1I . . . and UNI. Each of the IC units U0I, U1I . . . and UNI has a specific serial number 0, 1 . . . and N, respectively. The signal control circuit 23 is coupled to the power supply circuit 21 and the series of LED devices 22, and has a loaded status, such as fully loaded, half loaded, etc. The signal control circuit 23 changes the loaded status in response to a control signal SCON so as to cause the electrical parameter received by the IC units U0I, U1I . . . and UNI to have a variation, which generates a signal code ENC1 bearing at least an information. Each of the IC units U0I, U1I . . . and UNI in the series of LED devices 22 receives the signal code ENC1 simultaneously. When the signal code ENC1 corresponds to the specific serial number of one of the IC units U0I, U1I . . . and UNI (U0I, for example), the LED unit (U0L in this example) will be driven by the corresponding integrated circuit unit (U0I for example) based on an instruction IA1 existing in the information of the signal code ENC1.

In FIG. 2, the electrical parameter can be voltage, such as the total voltage, denoted as the first voltage V1, endured by the series of LED devices 22. In FIG. 3, the distribution voltage V1_div denotes the voltage distributed at each of the IC units U0I, U1I . . . and UNI. On condition that the manufacturing process is well controlled, the impedance of each of the IC units U0I, U1I . . . and UNI can be deemed equal, and therefore the distribution voltage at each of the IC units U0I, U1I . . . and UNI can be virtually the same, with merely minute deviation within an acceptable range.

Also in FIG. 2, the power supply circuit 21 comprises a first terminal T1, a second terminal T2, an AC-DC rectification circuit 211 including a bridge-type rectification circuit 213 and a capacitor C1, and a DC-DC transforming circuit 212. The AC voltage AC1 from the commercial electricity device 210 is rectified by the bridge-type rectification circuit 213 of the AC-DC rectification circuit 211 and transformed into a first voltage V1 to support the series of LED devices 22. The DC-DC transforming circuit 212 comprises a resistor R3, a Zener diode Z1 and a capacitor C2 disposed with the Zener diode Z1 in parallel. The resistor R3 and the Zener diode Z1 are disposed in series. The voltage level of the first voltage V1 drops across the resistor R3, and approaches that of the second voltage V2, which is clamped by the Zener diode Z1 for stabilizing the voltage.

The signal control circuit 23 comprises a third terminal T3, a fourth terminal T4, a processing unit 231 and a signal transmission circuit 232, including a switch unit Q1 and a load R1, such as a resistor. The processing unit 231 receives the second voltage V2, and is equipped with a control output terminal TCON for providing the control signal SCON, which controls the open or close of the switch unit Q1 via a resistor R2. The load R1 is electrically coupled to the third terminal T3 and fourth terminal T4. The switch unit Q1 is electrically coupled to the control output terminal TCON, and is also connected to the load R1 in parallel. The series of LED devices 22 has a fifth terminal T5 coupled to the first terminal T1 and a sixth terminal T6 coupled to the third terminal T3.

When the switch unit Q1 is switched on, the current I1 passing the series of LED devices 22 flows from the fifth terminal T5 to the third terminal T3, and flows to the ground of the fourth terminal T4 via the switch unit Q1 whose impedance is virtually zero. Thus, the voltage difference across the fifth terminal T5 to the sixth terminal T6 equals the first voltage V1. When the switch unit Q1 is open, the current I1 passing the series of LED devices 22 flows from the fifth terminal T5 to the third terminal T3, and flows to the ground of the fourth terminal T4 via the load R1, which results in a voltage drop ΔV1. Thus, the voltage difference across the fifth terminal T5 to the sixth terminal T6 equals to the first voltage V1 minus the voltage drop ΔV1. On condition that the manufacturing process is well controlled, the impedance of each of the IC units U0I, U1I . . . and UNI can be approximately identical, and consequently the reduction in the distribution voltage V1_div across each of the IC units U0I, U1I . . . and UNI can be virtually the same, which may equal the voltage drop ΔV1 divided by the total number of LED devices in the series of LED devices 22. The differences of voltage reduction across each of the IC units U0I, U1I . . . and UNI individually may be negligible.

Each of the LED units U0L, U1L . . . and UNL includes a red light LED (R-LED), a green light LED (G-LED) and a blue light LED (B-LED). Referring to FIG. 2, the LED unit U0L and the IC unit U0I are packaged together to form an LED device U0. Likewise, each of the LED units U0L, U1L . . . and UNL and the corresponding IC units U0I, U1I . . . and UNI can be packaged together to form the LED devices U0I, U1I . . . and UNI, respectively. Each of the IC units U0I, U1I . . . and UNI includes a power receiving terminal VIN, an IC ground terminal VSS, a first driving output terminal RL coupled to the R-LED, a second driving output terminal GL coupled to the G-LED and a third driving output terminal BL coupled to the B-LED. The negative electrodes of the R-LED, the G-LED and the B-LED are coupled to the IC ground terminal VSS.

Each of the IC units U0I, U1I . . . and UNI has a specific circuit structure, which can simultaneously detect the signal code ENC1 including an IC-circuit-unit-specific serial number and an instruction regarding how the specific IC unit should drive the corresponding LED unit. In FIG. 3, the two signal codes ENC1, ENC2 are separated by a time period Δt1 to allow the IC unit to identify signal codes in different time periods. The frequencies of signal codes ENC1, ENC2 are higher than 60 Hz, and can be higher than 100 Hz or even higher than one million (1 M) Hz. In other words, the periods of signal codes ENC1, ENC2 shall be less than 1/60 second, and preferably be less than a few microseconds. Since the frequency of the commercial A/C current is 60 Hz, having a period of 1/60 second, the LED circuit 2 and the method for driving the LED circuit 2 for transmitting signal codes ENC1, ENC2 should be fairly sufficient.

Figure 4:
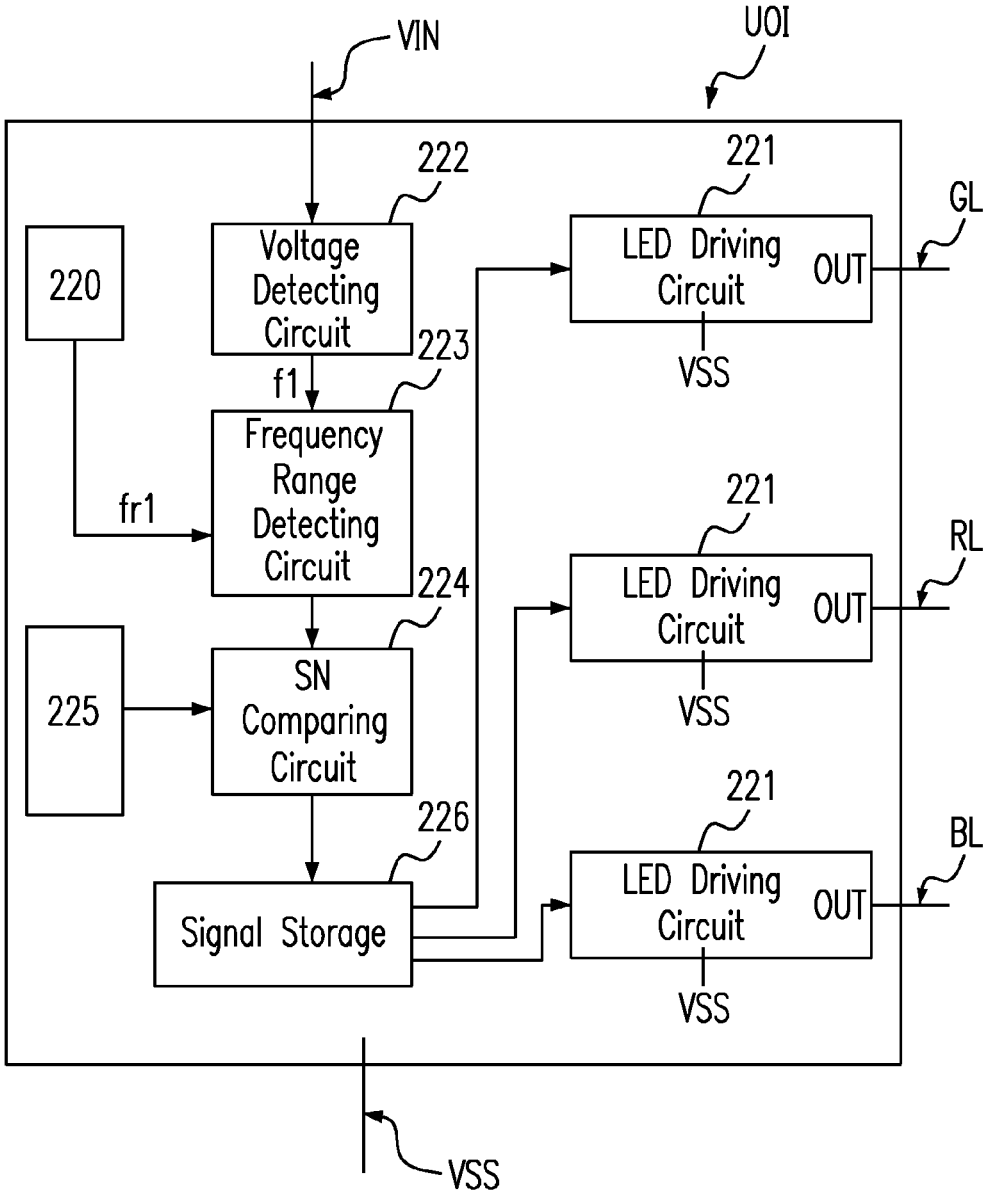
FIG. 4 is a schematic diagram showing the internal circuit of the IC unit according to one embodiment of the present invention.

Refer to FIG. 4, which is a schematic diagram showing the internal circuit of the IC unit U0I. Notably, the internal circuitry of the other IC units U1I . . . UNI are the same. The IC unit U0I includes an oscillator circuit 220 providing a reference frequency fr1, three LED driving circuits 221 for driving the R-LED, the G-LED and the B-LED, respectively, a power voltage detecting circuit 222 detecting the variation of an electrical parameter, a frequency range detecting circuit 223, a serial number comparing circuit 224 and a signal storage circuit 226. The variation of the electrical parameter, for example, a variation of the first voltage V1 within a range of the voltage drop ΔV1, may include a change in a power voltage having a working frequency f1. According to FIG. 3, the oscillation circuit 210 provides a reference frequency fr1. The frequency range detecting circuit 223 receives the reference frequency fr1 and determines whether the working frequency f1 is within an acceptable range. For example, the difference between the working frequency f1 and the reference frequency fr1 is within a specific range.

Each of the IC units U0I, U1I . . . and UNI has a specific serial number 0, 1 . . . and N respectively. The serial number may be formed by utilizing a fuse circuit being able to identify zero or one based on open circuit status or closed circuit status. Another method of formulating the serial number in an IC unit is to embed the code of the serial number at the stage of making photomasks. Another method is to dispose an embedded serial unit 225, such as an EEPROM and program the serial number thereinto for identification. The serial number comparing circuit 224 determines whether the specific serial number of the IC unit, say the serial number 0 of the IC unit U0I, corresponds to the received signal code ENC1 when the working frequency f1 is within an acceptable range. Note that the signal code ENC1 includes the identification code ID1 and information such as the instruction IA1 separated by a time period Δti1. The identification code ID1 is to be compared with the serial number, while the instruction IA1 indicates data regarding dim/light of the R-LED, the G-LED and the B-LED. According to one embodiment of the invention, the IC unit U0I starts to implement the instruction IA1 after the identification code ID1 and the serial number 0 have been determined to be the same. The other IC units U1I . . . and UNI in the series of LED devices 22 also receive the signal code ENC1 simultaneously. However, the instruction IA1 is not implemented when the identification code ID1 and the serial number 0 are not the same. In some embodiments of the present invention, different IC units have different serial numbers. In other embodiments, some different IC units may have the same serial number, which renders those IC units be a group. Such a method may work without repetitive transmission of the signals and increase the transmission efficiency of delivering signal coding. The signal storage circuit 226 receives the signal code ENC1 and stores the information when the specific serial number 0 and the identification code ID1 are the same.

The instruction IA1 is transmitted to the three LED driving circuits 221. For example, the instruction IA1 is a code "100", where the first number corresponds to the G-LED, the second number corresponds to the R-LED, and the third number corresponds to the B-LED". The LED driving circuit 221 for the G-LED receives the instruction "1" and illuminates the G-LED. The LED driving circuits 221 for the R-LED and the B-LED receive the instruction "0", and do not drive the R-LED and the B-LED, so the R-LED and the B-LED are at a dim status. Each of the LED driving circuits 221 receives the instruction IA1 and controls the dim/light status of the corresponding G-LED, R-LED or B-LED based on the instruction IA1, so as to implement light mixing to generate a variety of light colors.

Figure 5:
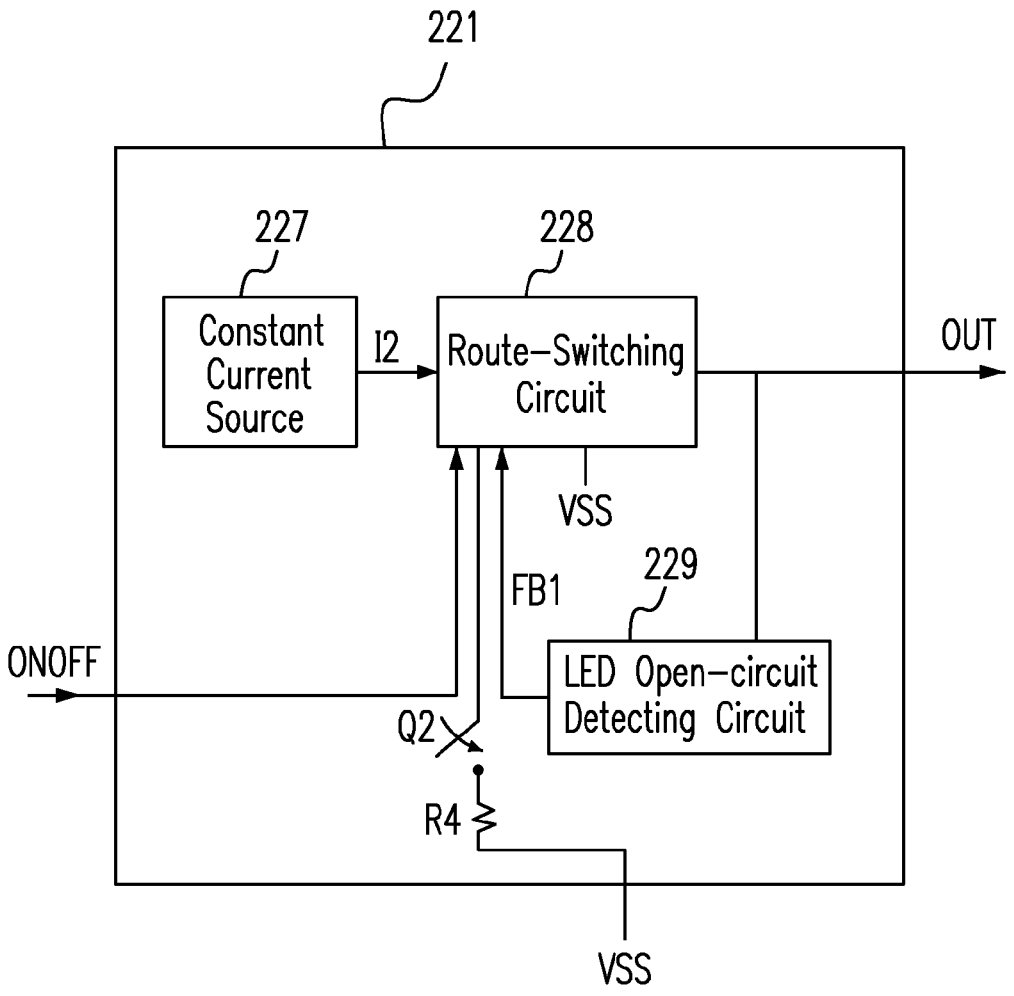
FIG. 5 is a schematic diagram showing the internal circuit structure of the LED driving circuit according to one embodiment of the present invention.

Refer to FIG. 5, which is a schematic diagram showing the internal circuit structure of the LED driving circuit 221.

According to one embodiment of the present invention, the LED driving circuit 221 may include a constant current source 227, a route-switching circuit 228 coupled to the constant current source 227, and an LED open-circuit detecting circuit 229 detecting an open-circuit status of the R-LED, the G-LED and the B-LED and providing a feedback signal FB1 to the route-switching circuit 228. The LED driving circuit 221 may further include a switch unit Q2 and a resistor R4. The constant current source 227 provides a constant current U2 to the route-switching circuit 228, which switches the route of the constant current U2 based on the instruction IA1. According to one embodiment, the route-switching circuit 228 receives the information comprising the instruction IA1 and the feedback signal FB1 to determine the direction of the constant current U2. Referring to FIGS. 3 and 5, the instruction IA1 relates to the On/Off status control of the R-LED, the G-LED and the B-LED. For example, in case the LED open-circuit detecting circuit 229 detects a malfunction of the R-LED, the G-LED or the B-LED, the feedback signal FB1 conveying this information is generated and transmitted to the route-switching circuit 228. The route-switching circuit 228 determines that the switch unit Q2 should be in a conducting (closed circuit) status so as to allow the current I2 to flow through the resistor R4 and all the way to the IC terminal VSS, based on the instruction IA1 from the ONOFF terminal and the feedback signal FB1.

The aforementioned method of current path switching overcomes the limitations of traditional methods, stabilizes the currents, and by virtue of its parallel LED connectivity, eliminates a significant limitation of systems connected in series taught by the prior art: namely, that the failure of a single component in series will cause the entire series of components to fail. Referring to FIG. 2, the negative electrodes of the R-LED, the G-LED and the B-LED are connected to the IC terminal VSS. If the R-LED, the G-LED and the B-LED are illuminated, the path of the current I2 passes along the terminal OUT of the IC unit UNI, one of the R-LED, the G-LED and the B-LED, the terminal VSS of IC unit U1I and the terminal VIN of the next IC unit U0I. Different from the prior art LED circuits, the concept of the present invention allows the current I1 to be diverted into the terminal VIN of the next IC unit when the R-LED, the G-LED or the B-LED fails, so the other LED units may be illuminated, which benefits to the stabilization of the current I1 flowing through the IC units U0I, U1I, . . . UNI. Besides, the series of LED devices 22 can still function although one or more of the LED units fail. It will be much easier for one to identify the failed unit in this case. For example, one may try to illuminate all the LED units to verify if there exists any failed LED component among the LED units, so the failed component can be replaced.

Figure 6:
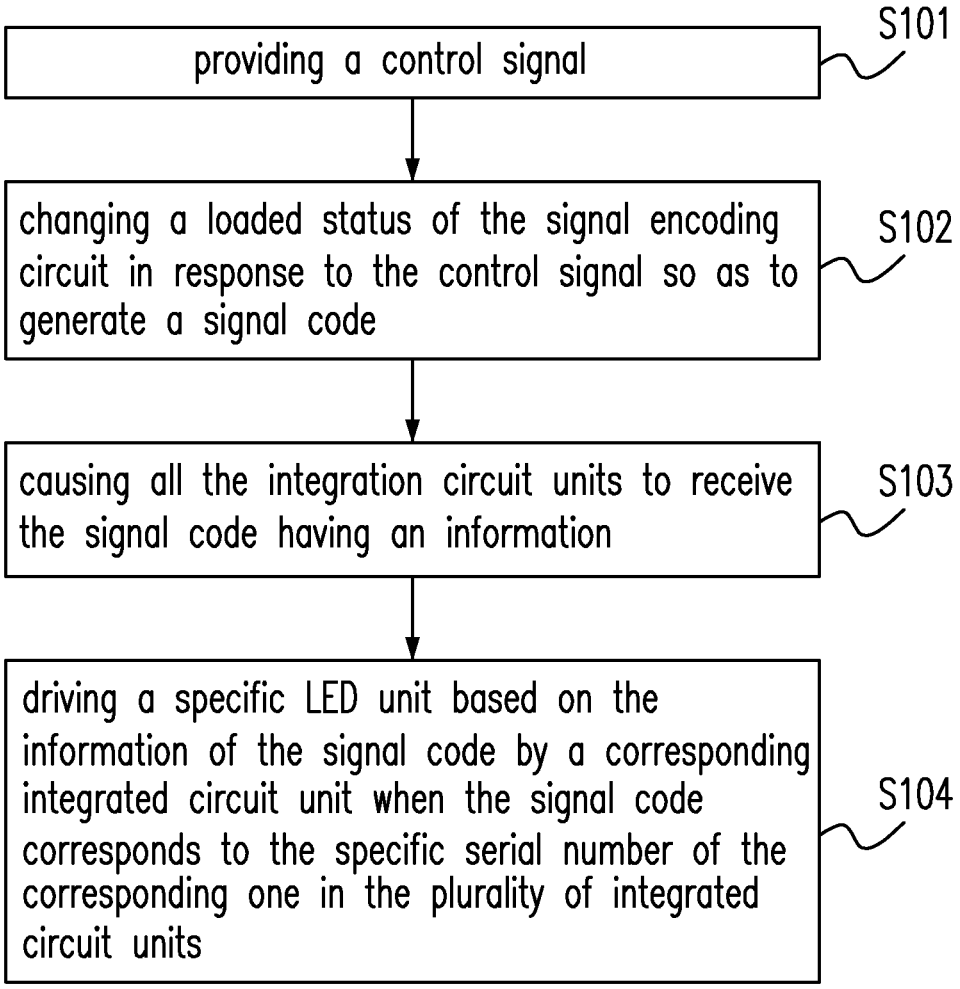
FIG. 6 is a schematic diagram showing the driving method for the LED unit according to one embodiment of the present invention.

Please refer to FIG. 6, which is a schematic diagram showing the driving method for the LED circuit 2 according to one embodiment of the present invention. Please also refer to FIG. 2, wherein the LED circuit 2 includes a series of LED devices 22 and a signal control circuit 23. The series of LED devices 22 includes a plurality of LED units U0L, U1L . . . and UNL, each of which has an IC unit U0I, U1I . . . and UNI. Each of the IC units U0I, U1I . . . and UNI has a specific serial number 0, 1 . . . and N, respectively. The method of driving the LED circuit 2 including the following steps: step S101, providing a control signal; step S102, changing a loaded status of the signal encoding circuit in response to the control signal so as to generate a signal code, wherein the signal code is borne by an electrical parameter received by the plurality of LED devices U0, U1 . . . and UN, and the signal code is due to a variation of the electrical parameter; step S103, causing all the integrated circuit units to receive the signal code having an information simultaneously; and step S104, driving a specific LED unit based on the information of the signal code by a corresponding integrated circuit unit when the signal code corresponds to the specific serial number of the corresponding one in the plurality of integrated circuit units. Notably, the information of the signal code may include an instruction for driving the LED units.

Again referring to FIGS. 2 and 6, the electrical parameter received by each of the IC units is voltage. In terms of AC/DC power interconversion and changing of load control, the method for driving the LED circuit 2 may further include the following steps: providing a first voltage V1 to support the plurality of IC units U0I, U1I . . . and UNI, and transforming the first voltage V1 into the second voltage V2 so as to support to the processing unit 231; and controlling the on/off status of the switch unit Q1 of the signal coding circuit to generate a change of the loading status. In terms of detecting signal coding, the method for driving the LED circuit 2 may further include the following steps: detecting a change of the electrical parameter such as a change of the power voltage, wherein the variation of the electrical parameter includes a variation of a power voltage having a working frequency; receiving a reference frequency and determining whether the working frequency is within an acceptable range; determining whether the specific serial number of each of the integrated circuit units corresponds to the signal code when the working frequency is within the acceptable range, wherein the signal code includes an identification code and an information including an instruction; and receiving the signal code, and storing the information when the specific serial number and the identification code are the same.

Figure 7:
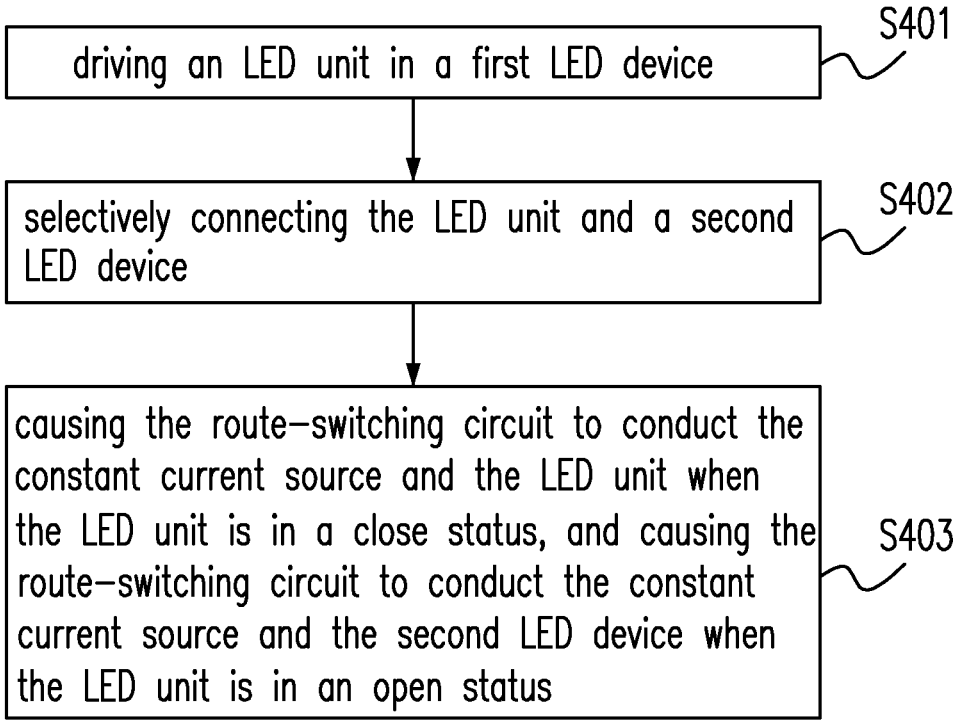
FIG. 7 is a schematic diagram showing the driving method for the LED driving circuit according to one embodiment of the present invention.

Please refer to FIG. 7, which is a schematic diagram showing the driving method for the LED driving circuit 221. The method includes the following steps: step S401, driving an LED unit in a first LED device; step S402, selectively connecting the LED unit and a second LED device; and step S403, causing the route-switching circuit 228 to conduct the constant current source I2 and the LED unit when the LED unit is in a closed status, and causing the route-switching circuit 228 to conduct the constant current source I2 and the second LED device when the LED unit is in an open status.

In general, there are two factors that determine the current I1 flow into each of the IC units: the circuit character and the element character. Since the plurality of IC units U0I, U1I . . . and UNI are coupled in series, the current I1 flowing through each of the IC units should be the same on condition that the manufacturing process for making the IC units is welled controlled. However, in the case of process drifting, the produced elements may vary according current consumption and self-impedance of the IC unit, resulting in inconsistency of element character and causing code errors received by different elements. For example, if, in FIG. 2, there exists a large difference in impedance between the two IC units U1I, U0I connected in series, the difference in the reduction of the divisional voltage V1_div by each of the two IC units U1I, U0I should be large, which may cause coding errors of the received signals. To resolve such an issue, a simple method is to measure the element character of each of the IC units, categorize the IC units based on similar element character, and dispose the IC units of the same category so as to avoid the effect due to process drift.

Another method is to dispose the IC units U0I, U1I . . . and UNI with resistors RU0, RU1 . . . and RUN in parallel, respectively. These resistors may be directly manufactured in each of the IC units, or by respectively coupled with the IC units after the packaging process for the IC units has been completed. Please refer to FIG. 8, which is a schematic diagram showing the LED circuit 3 according to another embodiment of the present invention. The LED circuit 3 is similar to the LED circuit 2 illustrated in FIG. 2 except that the resistors are individually disposed with the IC circuits in parallel. The LED circuit 3 comprises a series of LED devices 32, a processing unit 231 and a signal control circuit 33. The series of LED devices 32 includes a plurality of LED units U0L, U1L . . . and UNL, each of which has an IC circuit unit U0I, U1I . . . and UNI respectively. Each of the IC units U0I, U1I . . . and UNI has a specific serial number 0, 1 . . . and N, respectively. The processing unit 231 includes an input terminal VCC receiving a DC input V2 and an output terminal TCON. The signal control circuit 33 is electrically coupled to the output terminal TCON and the plurality of LED units U0L, U1L . . . and UNL therebetween and transmits an electrical parameter bearing specific signal codes ENC1, ENC2 (referring to FIG. 3) to each of the IC units U0I, U1I . . . and UNI. According to a preferred embodiment, each of the IC units U0I, U1I . . . and UNI receives the signal codes ENC1, ENC2 simultaneously. When the signal code ENC1 corresponds to the specific serial number of one of the IC units U0I, U1I . . . and UNI (U0I, for example), the LED unit (U0L in this example) will be driven by the corresponding integrated circuit unit (U0I in this example) based on an instruction IA1 existing in the information of the signal code ENC1.

Figure 8:
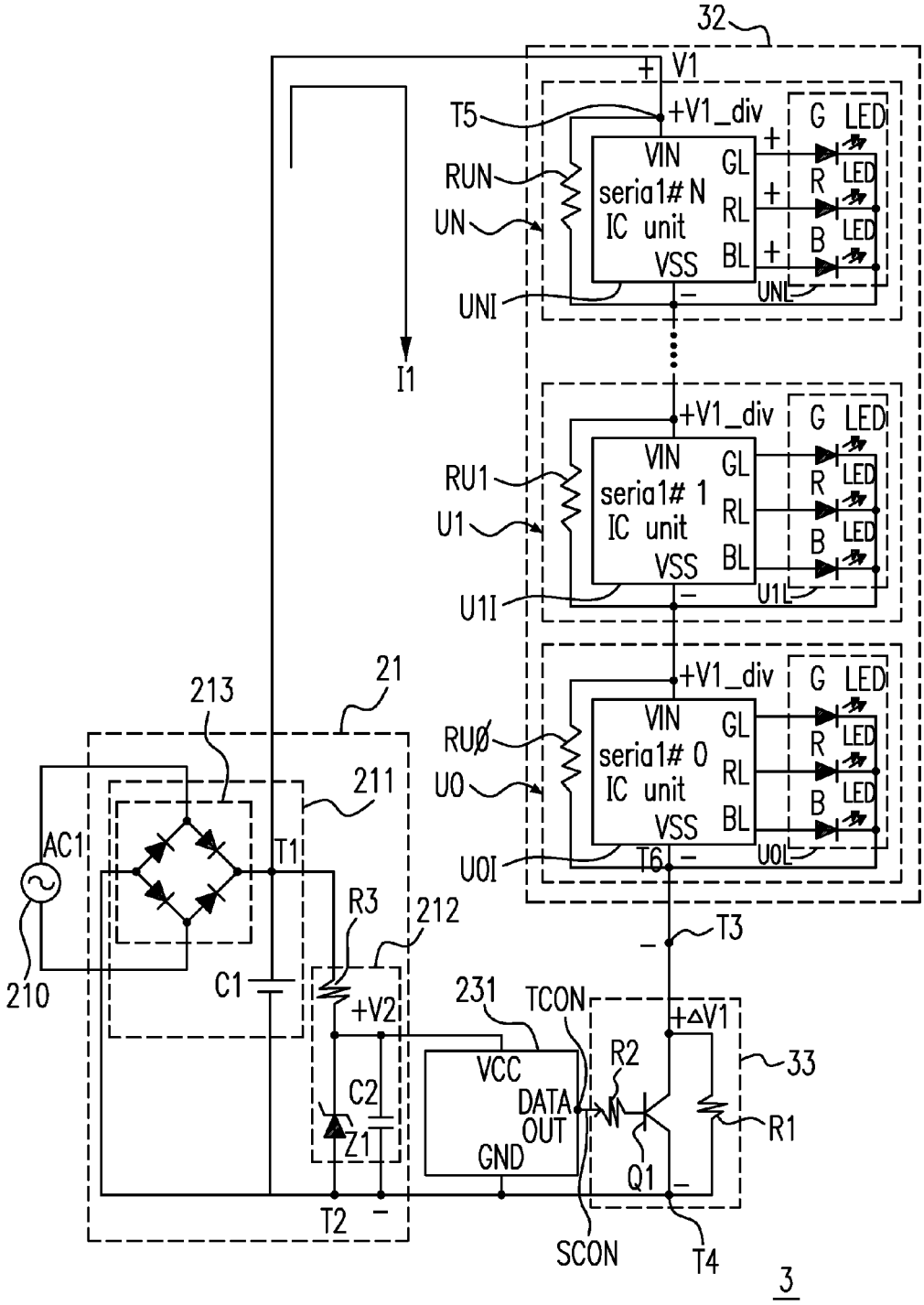
FIG. 8 is a schematic diagram showing the LED circuit according to another embodiment of the present invention.

In FIG. 8, the resistors RU0, RU1 . . . and RUN may reduce the differences among the plurality of IC units U0I, U1I . . . and UNI, so as to render the divisional voltage at each IC unit virtually the same. The resistors RU0, RU1 . . . and RUN may also be used for compensating bias of the equivalent impedance among the plurality of IC units U0I, U1I . . . and UNI, if there exists a large bias. Thus, the divisional voltage at each IC unit can be virtually the same, which may avoid errors due to differences in impedance when receiving signal codes. From the aspect of current consumption, the difference among the IC units due to processing issues can be compensated by the plurality of loads, so the voltage received by each of the IC units is virtually the same.

Each of the IC units U0I, U1I . . . and UNI in FIG. 8 comprises three LED driving circuits, as shown in FIG. 4. Also referring to FIGS. 4 and 5, the LED driving circuit 221 may include a constant current source 227, a route-switching circuit 228 coupled to the constant current source 227, and an LED open-circuit detecting circuit 229 detecting an open-circuit status of the R-LED, the G-LED and the B-LED. The route-switching circuit 228 can be selectively coupled to either the LED unit U1L or the second LED unit U0L. The route-switching circuit 228 conducts the constant current source 227 and the LED unit U1L when the LED open-circuit detecting circuit 229 determines that the LED unit U1L is in a closed status, and conducts the constant current source 227 and the second LED device U0 when the LED unit U1L is in an open status.

Figure 9:
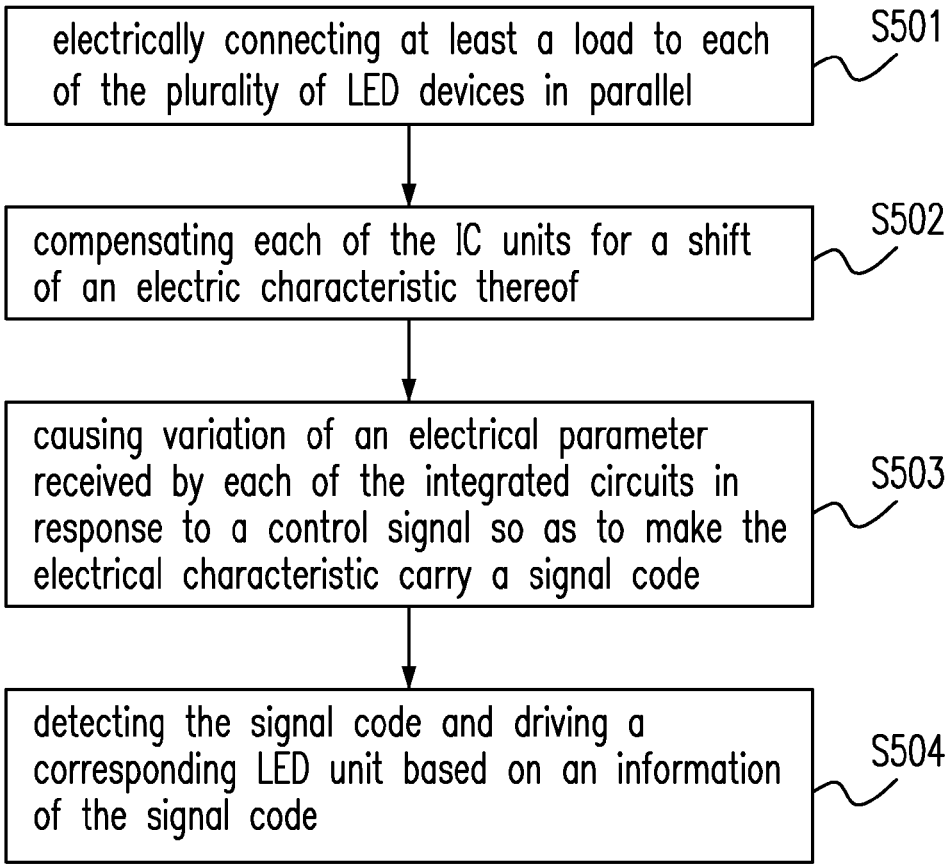
FIG. 9 is a schematic diagram showing the compensating method used by the LED driving circuit according to one embodiment of the present invention.

Please refer to FIG. 9, which is a schematic diagram showing the compensating method used by the LED driving circuit 3 according to one embodiment of the present invention. The LED circuit 3 comprises at least one series of LED devices U0, U1 . . . and UN and a signal control circuit 33. Each of the plurality of LED devices U0, U1 . . . and UN has an IC circuit unit U0I, U1I . . . and UNI and an LED unit U0L, U1L . . . and UNL, respectively. Each of the IC units U0I, U1I . . . and UNI has a specific serial number 0, 1 . . . and N, respectively. The compensating method includes the following steps: step S501, electrically connecting at least one load to each of the plurality of LED devices U0, U1 . . . and UN in parallel; step S502, compensating each of the IC units U0I, U1I . . . and UNI for a shift of an electric characteristic thereof; step S503, causing variation of an electrical parameter received by each of the IC units U0I, U1I . . . and UNI in response to a control signal SCON so as to make the electrical characteristic carry a signal code ENC1; and step S504, detecting the signal code SCON and driving a corresponding LED unit based on an information IA1 of the signal code SCON.

While the invention has been described in terms of what are presently considered to be the most practical and preferred embodiments, it is to be understood that the invention need not be limited to the disclosed embodiments. On the contrary, it is intended to cover various modifications and similar arrangements included within the spirit and scope of the appended claims, which are to be accorded the broadest interpretation possible, so as to encompass all such modifications and similar structures.

Embodiments:

1. An LED circuit, comprising: a series of LED devices, each of the LED devices includes an LED unit and an integrated circuit unit having a specific serial number and receiving an electrical parameter; a power supply circuit coupled to the series of LED devices; and a signal control circuit coupled to the power supply circuit and the series of LED devices, and having a loaded status, wherein the signal control circuit changes the loaded status in response to a control signal so as to cause the electrical parameter to have a variation, the variation of the electrical parameter generates a signal code having an information, all the integrated circuit units receive the signal code, and a specific LED unit will be driven by a corresponding integrated circuit unit when the signal code corresponds to the specific serial number of the corresponding integrated circuit unit.

2. The LED circuit of Embodiment 1, wherein the electrical parameter is a voltage, the signal control circuit changes the loaded status to cause a change of total voltage difference of the integrated circuit units in the series of LED devices, and the change of total voltage difference is uniformly distributed to changes of individual voltage differences of the integrated circuit units.

3. The LED circuit of Embodiment 1, wherein each of the LED units includes a red light LED (R-LED), a green light LED (G-LED) and a blue light LED (B-LED), each of the integrated circuit units includes a power receiving terminal, an IC ground terminal, a first driving output terminal coupled to the R-LED, a second driving output terminal coupled to the G-LED and a third driving output terminal coupled to the B-LED, and the negative electrodes of the R-LED, the G-LED and the B-LED are commonly coupled to the IC ground terminal.

4. The LED circuit of Embodiment 1, wherein the power supply circuit has a first terminal and a second terminal, and further includes: a rectifier circuit coupled to the first terminal to provide a first voltage to the integrated circuit units; and a converting circuit coupled between the first terminal and the second terminal to convert the first voltage to a second voltage.

5. The LED circuit of Embodiment 4, wherein the signal control circuit has a third terminal and a fourth terminal, the integrated circuit units in the series of LED devices have a fifth terminal coupled to the first terminal and a sixth terminal coupled to the third terminal, and the LED circuit further includes: a processing unit receiving the second voltage, and having an output control terminal to provide the control signal; a load coupled between the third and the fourth terminals; and a switch unit coupled to the output control terminal, and coupled to the load in parallel, wherein the second terminal is coupled to the fourth terminal, and the switch unit receives the control signal controlling an open-closed status of the switch unit to change the loaded status.

6. The LED circuit of Embodiment 1, wherein each of the integrated circuit units includes: a power voltage detecting circuit detecting the variation of the electrical parameter, wherein the variation includes a change of a power voltage having a working frequency; an oscillator circuit providing a reference frequency; a frequency range detecting circuit receiving the reference frequency, and determining whether the working frequency is within an acceptable range; a serial number comparing circuit determining whether the specific serial number of the integrated circuit unit corresponds to the signal code when the working frequency is within an acceptable range, wherein the signal code includes an identification code and the information; and a signal storage circuit receiving the signal code, and storing the information when the specific serial number and the identification code are the same.

7. The LED circuit of Embodiment 1, wherein each of the LED units includes a red light LED (R-LED), a green light LED (G-LED) and a blue light LED (B-LED), and each of the integrated circuit unit further includes: an LED driving circuit including: a constant current source providing a constant current; a route-switching circuit coupled to the constant current source to switch the route of the constant current; and an LED open-circuit detecting circuit detecting an open-circuit status of the LED unit to provide a feedback signal, wherein the route-switching circuit receives the information and the feedback signal to determine whether to provide the LED unit with the constant current to drive the R-LED, the G-LED and the B-LED.

8. A method for driving an LED circuit comprising a plurality of integrated circuit units, a plurality of LED units and a signal-encoding circuit, wherein each of the integrated circuit units has a specific serial number, the method comprising steps of: (a) providing a control signal; (b) changing a loaded status of the signal encoding circuit in response to the control signal so as to generate a signal code; (c) causing all the integration circuit units to receive the signal code having an information; and (d) driving a specific LED unit based on the information of the signal code by a corresponding integrated circuit unit when the signal code corresponds to the specific serial number of the corresponding one in the plurality of integrated circuit units.

9. The method of Embodiment 8, wherein the signal code represents a variation pattern of an electrical parameter, the electrical parameter is a voltage, and the method further comprises the following steps of: providing the plurality of integrated circuit units with a first voltage and converting the first voltage to a second voltage to be supplied to a processing unit; and controlling one of an open status and a close status of a switch unit of the signal encoding circuit to change the loaded status.

10. The method of Embodiment 9, further comprising the following steps of: detecting the variation of the electrical parameter, wherein the variation of the electrical parameter includes a variation of a power voltage having a working frequency; determining whether the working frequency is within an acceptable range; determining whether the specific serial number of each of the integrated circuit units corresponds to the signal code when the working frequency is within an acceptable range, wherein the signal code includes an identification code and the information; and receiving the signal code, and storing the information when the specific serial number and the identification code are the same.

11. The method of Embodiment 10, further comprising the following steps of: providing a constant current; providing an LED open-circuit detecting circuit to detect an open-circuit status of each of the LED units to provide a feedback signal; and receiving the information and the feedback signal to determine whether to provide the detected LED unit with the constant current.

12. A method for driving an LED circuit comprising a signal encoding circuit and a plurality of LED devices, wherein each of the LED devices includes an LED unit and an integrated circuit unit having a specific serial number, the method comprising steps of: electrically connecting at least a load to the plurality of LED devices in parallel; and compensating each of the integrated circuits for a shift of an electric characteristic thereof.

13. The method of Embodiment 12, wherein the integrated circuit units are coupled in series to receive an electrical parameter and a variation of the electrical parameter produces a signal code having an information.

14. The method of Embodiment 13, wherein a specific one of the integrated circuit units drives the corresponding LED unit based on the information of the signal code when the specific serial number of the integrated circuit corresponds to the signal code.

15. The method of Embodiment 13, wherein the electrical parameter is a voltage.

16. The method of Embodiment 12, wherein the electric characteristic includes a consuming current of the integrated circuit unit and a self impedance of the integrated circuit unit.

17. The method of Embodiment 12, wherein the respective load is configured to compensate each of the integrated circuit units for the shift of the electric characteristic thereof to render a received voltage of all integrated circuits virtually the same when an equivalent impedance of any of the integrated circuit units has the shift.

18. An LED circuit, comprising: a plurality of LED devices, each of which includes an LED unit and an integrated circuit unit having a specific serial number; a processing unit having an output terminal; and a signal control circuit coupled to the output terminal and the plurality of LED devices, and transmitting an electrical parameter carrying a specific signal code to each of the integrated circuit units, wherein a specific integrated circuit unit drives a corresponding LED unit when the specific integrated circuit unit identifies the specific signal code.

19. The LED circuit of Embodiment 18, wherein the electrical parameter is continuously generated under a frequency larger than 60 Hz, and the electrical parameter is a voltage.

20. An integrated circuit for an LED circuit, comprising: a constant current source driving an LED unit in a first LED device; a route-switching circuit selectively connecting the LED unit and a second LED device; and an LED open-circuit detecting circuit causing the route-switching circuit to conduct the constant current source and the LED unit when the LED unit is in a close status, and causing the route-switching circuit to conduct the constant current source and the second LED device when the LED unit is in an open status.

What is claimed is:

1. An LED circuit, comprising:

a series of LED devices, wherein each of the LED devices includes an LED unit and an integrated circuit unit having a specific serial number and receiving an electrical parameter, and each of the LED units comprises a red light LED (R-LED), a green light LED (G-LED) and a blue light LED (B-LED);

a power supply circuit coupled to the series of LED devices; and a signal control circuit coupled to the power supply circuit and the series of LED devices, and having a loaded status, wherein the signal control circuit changes the loaded status in response to a control signal so as to cause the electrical parameter to have a variation, the variation of the electrical parameter generates a signal code having an information, all the integrated circuit units receive the signal code, and a specific LED unit will be driven by a corresponding integrated circuit unit when the signal code corresponds to the specific serial number of the corresponding integrated circuit unit, wherein each of the integrated circuit units comprises:

an LED driving circuit comprising:

a constant current source providing a constant current;

a route-switching circuit coupled to the constant current source to switch the route of the constant current; and an LED open-circuit detecting circuit detecting an open-circuit status of the LED unit to provide a feedback signal, wherein the route-switching circuit receives the information and the feedback signal to determine whether to provide the LED unit with the constant current to drive the R-LED, the G-LED and the B-LED.

2. The LED circuit as claimed in claim 1, wherein the electrical parameter is a voltage, the signal control circuit changes the loaded status to cause a change of total voltage difference of the integrated circuit units in the series of LED devices, and the change of total voltage difference is uniformly distributed to changes of individual voltage differences of the integrated circuit units.

3. The LED circuit as claimed in claim 1, wherein each of the LED units includes a red light LED (R-LED), a green light LED (G-LED) and a blue light LED (B-LED), each of the integrated circuit units includes a power receiving terminal, an IC ground terminal, a first driving output terminal coupled to the R-LED, a second driving output terminal coupled to the G-LED and a third driving output terminal coupled to the B-LED, and the negative electrodes of the R-LED, the G-LED and the B-LED are commonly coupled to the IC ground terminal.

4. The LED circuit as claimed in claim 1, wherein the power supply circuit has a first terminal and a second terminal, and further includes:

a rectifier circuit coupled to the first terminal to provide a first voltage to the integrated circuit units; and a converting circuit coupled between the first terminal and the second terminal to convert the first voltage to a second voltage.

5. The LED circuit as claimed in claim 4, wherein the signal control circuit has a third terminal and a fourth terminal, the integrated circuit units in the series of LED devices have a fifth terminal coupled to the first terminal and a sixth terminal coupled to the third terminal, and the LED circuit further includes:

a processing unit receiving the second voltage, and having an output control terminal to provide the control signal;

a load coupled between the third and the fourth terminals; and a switch unit coupled to the output control terminal, and coupled to the load in parallel, wherein the second terminal is coupled to the fourth terminal, and the switch unit receives the control signal controlling an open-closed status of the switch unit to change the loaded status.

6. The LED circuit as claimed in claim 1, wherein each of the integrated circuit units includes:

a power voltage detecting circuit detecting the variation of the electrical parameter, wherein the variation includes a change of a power voltage having a working frequency;

an oscillator circuit providing a reference frequency;

a frequency range detecting circuit receiving the reference frequency from the oscillator circuit, and detecting a specified range difference between the reference frequency and the working frequency;

a serial number comparing circuit determining whether the specific serial number of the integrated circuit unit corresponds to the signal code based on the detected specified range difference, wherein the signal code includes an identification code and the information; and a signal storage circuit receiving the signal code, and storing the information once the serial number comparing circuit determines that the specific serial number and the identification code are the same, implementing the stored information including an instruction based on determining the specific serial number and the identification code are the same.

* * * * *